United States Patent [19]

Robinson

[11] Patent Number: 5,071,014

[45] Date of Patent: Dec. 10, 1991

[54] HORIZONTAL FILE RACK

[76] Inventor: Calford E. Robinson, 100 Leander Street, Bramalea, Ontario, Canada, L6S 3N8

[21] Appl. No.: 595,278

[22] Filed: Oct. 10, 1990

[30] Foreign Application Priority Data

Oct. 19, 1989 [CA] Canada ..... 2001069

[51] Int. Cl.[5] ..... A47B 43/00

[52] U.S. Cl. ..... 211/204; 211/162; 211/206; 248/165

[58] Field of Search ..... 248/166, 165; 211/204, 211/206, 123, 189, 195, 198, 201, 203, 162; 403/206, 309, 353

[56] References Cited

U.S. PATENT DOCUMENTS

| | | | |
|---|---|---|---|
| 751,466 | 2/1904 | Colling | 211/162 |
| 1,966,283 | 7/1934 | Brody | 211/162 X |
| 2,336,802 | 12/1943 | Posner | 211/162 |
| 2,810,388 | 10/1957 | Conley | 211/162 |
| 2,852,028 | 9/1958 | Patterson | 211/162 |
| 2,871,861 | 2/1959 | Posner | 211/162 |
| 4,030,610 | 6/1977 | Alexander | 211/189 X |
| 4,091,933 | 5/1978 | Alexander | 312/184 X |
| 4,262,810 | 4/1981 | Ilich | 211/206 |

*Primary Examiner*—J. Franklin Foss

[57] ABSTRACT

A frame for supporting hanging files comprising two front and two rear standards with hanger rails joining the tops of the standards on each side. Each of the two front and the two rear standards is joined to its front or rear counterpart with horizontal members that partially interlock to form a complete suspension frame.

17 Claims, 3 Drawing Sheets

FIG.1.
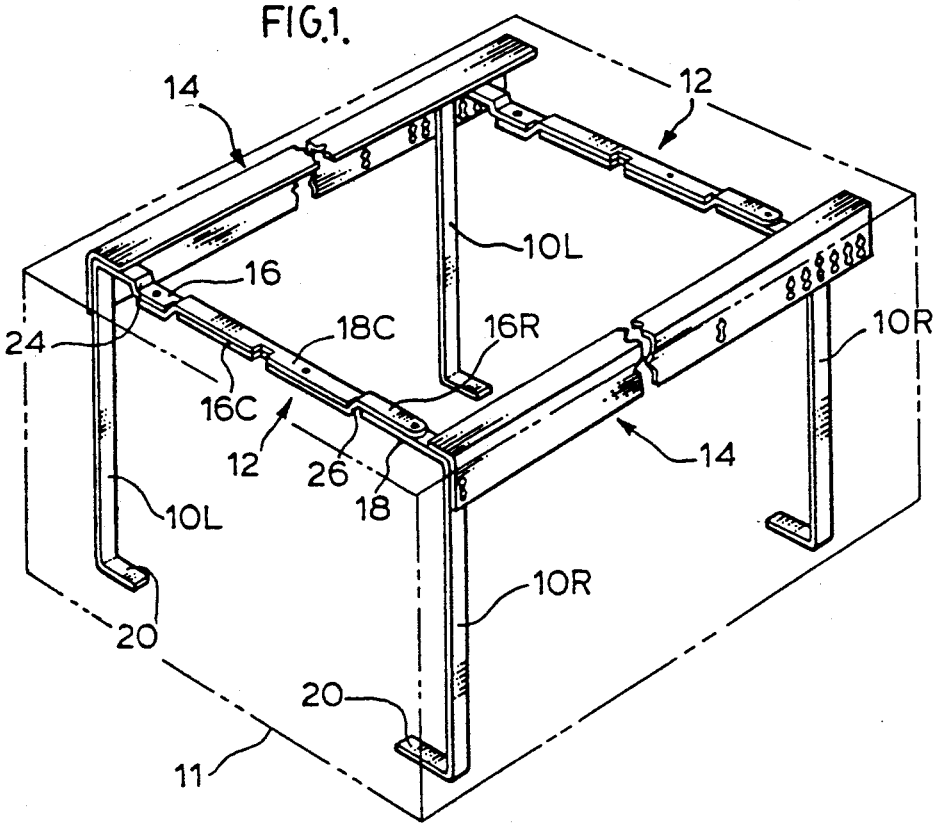
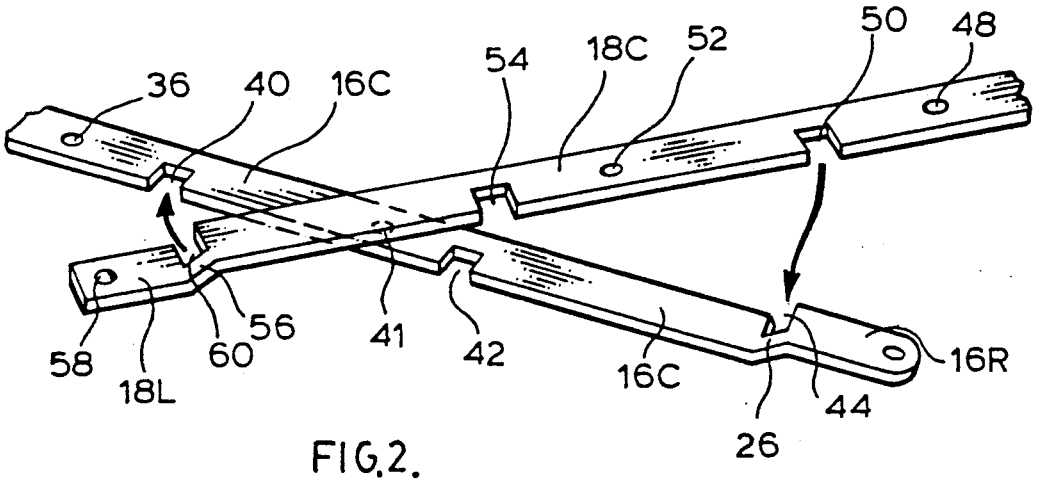
FIG.2.

FIG.3A.
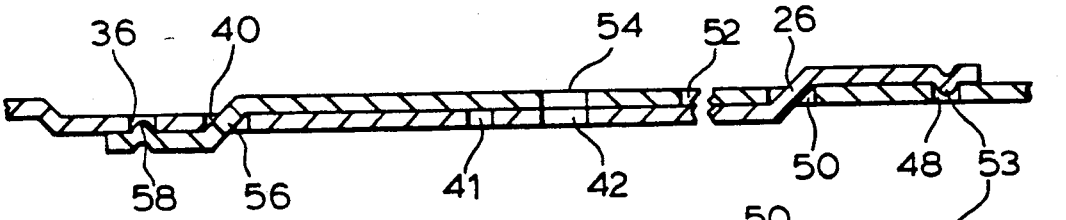
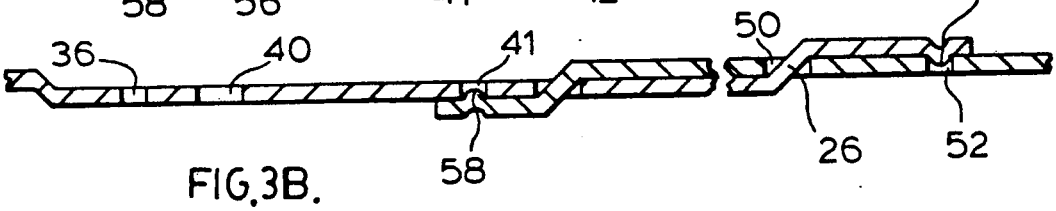
FIG.3B.
FIG.4.
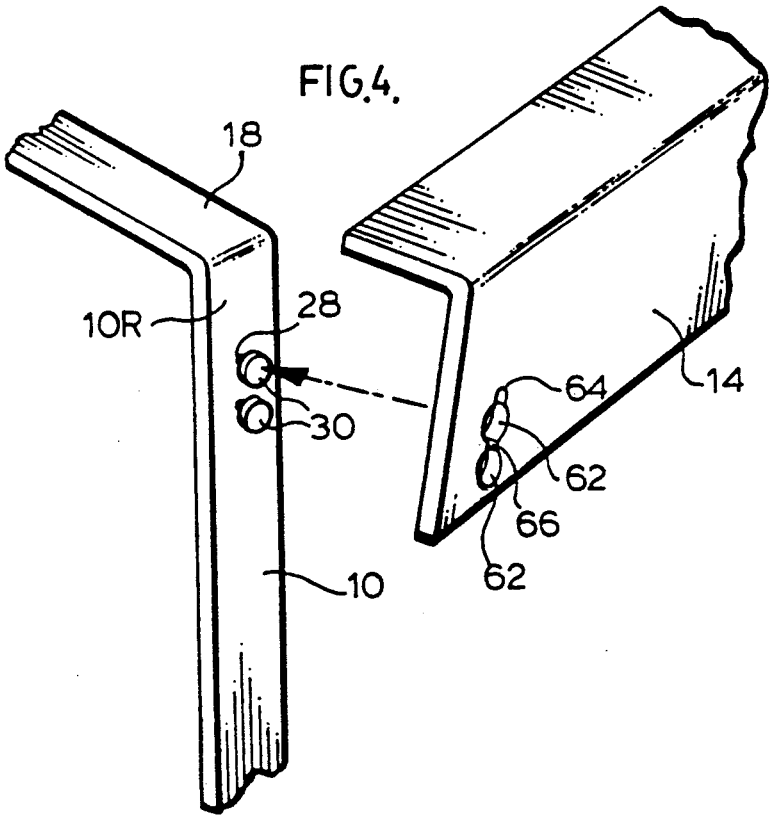

HORIZONTAL FILE RACK

This invention relates to means providing a frame for hanging files. The inventive frame may be used to convert file drawers for hanging files or to stand on a desk top or other surface. The hanging file frame provides file drawers designed to receive files resting on the bottom of the drawer with suspension rails on each side of the drawer on which the hanging files may be suspended.

Although the invention is principally discussed for use inside a file drawer it should be noted that the inventive frame may also sit on a desk top or other surface.

The invention is of the class of devices which provide vertical standards to stand on the bottom of the drawer near the four corners, which standards are connected by transverse members joining their upper ends at the forward and rearward ends of the drawer. The standards and cross members support longitudinal rails adjacent the top of the drawer, and on each side thereof; located to support vertical hanging files. Prior devices of the above type, known to applicant, have required nuts and bolts or extra fittings for assembly, and for this and other reasons are inconvenient to transport and to assemble and disassemble.

Applicant provides a frame simple to transport in compact kit form and to assemble by mechanical interlock, without requiring extra bolts or connection members.

In accord with applicant's invention the standard transverse members and rails may be assembled to form a rigid structure. The transverse members are each formed of a right hand and left hand:stiff, resilient cross members which overlap along a overlap extent. Two interlock locations are provided between the cross members along the overlap extent. At one interlock location the right hand member is adapted to bear on the left to rotate it in one direction about an axis perpendicular to the transverse direction. At the other interlock location the right hand member is adapted to bear on the left to rotate it in the opposite direction about a parallel axis. Thus the stiff resilient cross members flex each other to provide a rigid but detachable connection.

In a preferred form of the invention each cross member is formed integrally with the standard on the side of the drawer from which it extends.

In a preferred form of the invention the cross members are made out of flat strips and the right and left cross members thus flex each other on opposite directions about axes parallel to the flat strip sides at the two interlock locations.

In a preferred form of the invention releasable cooperating detent means are provided on interlocking cross members arranged to releasably retain said cross members in interlocking relationship.

In a preferred form of the invention, the cross members are made out of flat strips and the right and left cross members are provided with mutually facing notches at locations corresponding to the two interlock locations. The notches extend approximately half way across the strip. At each interlock location the notch in each strip receives the material opposite the notch in the other and the strips' side by side positions are reversed in position at each interlock location with dimensions designed to provide the desired flexing. Preferably a raised member on one cross member corresponds to a depression or aperture in the other to releasably retain the interlocked orientation of the interlocked strips.

With a conversion frame with interlocking cross members there is disclosed herein novel means for releasably connecting the interlocked cross members to the longitudinal rails to form a rigid frame with the rails located to support hanging files. The inventive means for providing the rigid connection between the standards and cross members on the one hand and the rails on the other is described in connection with the preferred embodiment.

Preferably the cross members are made integral with the standard from which they extend.

Preferably with interlocking flat strips defining mutually facing notches the strips are constructed so that one of said strips jogs upwardly at its notch corresponding to one interlock location while the other strip is straight at the facing notch. The other of the strips jogs downwardly at its notch corresponding to the other interlock location while the one strip is straight at the notch facing such other location. At each interlock location the thickness of the straight strip is just greater than the open spacing between the surfaces of the strip with the jog. By 'open spacing' is meant the spacing between the lower surface on the high part of the jog and the upper surface on the low part of the jog. The open spacing clearance being just less than the thickness of the other strip creates the interference between the strips to provide the rigid connection.

In a preferred form of the invention, the cross members are designed so that there are two alternative length overlap extents, each with its pair of interlock locations, so that the frame may be assembled with the side rails at alternate widths for alternate sizes of files, such as 'letter' and 'legal' size.

In drawings which illustrate a preferred embodiment of the invention :

FIG. 1 is a perspective of a frame in accord with invention,

FIG. 2 shows a detail of the interlocking procedure,

FIG. 3A is a section showing the interlock for letter size files,

FIG. 3B is a section showing the interlock for legal size files,

FIG. 4 is a detail perspective showing the longitudinal rail interlock,

Figure 5:
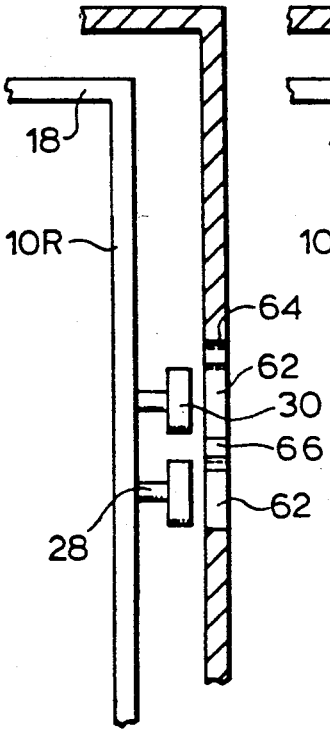
FIG. 5 shows a section at the initiation of the rail attachment.

In the drawings the frame generally comprises forward and rearward pairs of standards 10 for standing near the four corners on the bottom of the file drawer, forward and rearward transverse members 12 and longitudinally extending side rails 14 which extend between the forward and rearward members 10 and 12 at a height and spacing to support hanging files. The position of the drawer outline is shown by lines 11.

In the preferred embodiment, each transverse member 12 is comprised of right and left hand cross members 16 and 18 and each right and left hand cross member is formed integrally with the standard 10 from which it extends.

Thus, each of the forward and rearward left hand standards 10 comprises a mild steel strip of stiff resiliency arranged to have its flat side parallel to the side of the drawer, and an integrally extending horizontal foot 20 turned at 90° to the standard to rest flat on the bottom of the drawer. The standard 10R at its upper end is bent inwardly to form the right hand cross member 16. A short distance inwardly of each left hand standard 10L the horizontally extending cross member jogs downwardly a short distance at 24 at about 45° to its central horizontal extent 16C and adjacent its right hand end the central horizontal extent 16C jogs upwardly a short distance at 26 at 45° to an horizontal extent 16R. Projectingly outwardly from each standard 10 adjacent its upper end are a pair of relatively vertically disposed fixed rivets having a shank 28 and a head 30 spaced from the outer surface of standard 10. In the horizontal extent 16C looking rightward are a small aperture 36 followed by slot 40 and small aperture 41 spaced from a slot 42. The slots 40 and 42 extend about ½ way across the strip from one side edge and face in a predetermined direction, here forwardly, relative to the file drawer. A slot 44 is formed preferably in the opposite edge of the strip over the extent of the upward sloping portion 26. The legth of the upwardly sloping portion 26 at the jog is chosen so that the spacing between the upper side of extent 16C and the lower side of the strip 16R (the 'open spacing') is just less than the thickness of the right hand strip 18 (which is the same thickness as strip 16) and for a purpose to be described. Extent 16R has a downwardly facing boss 53. Slot 44 extends about halfway across the strip.

Figure 7:
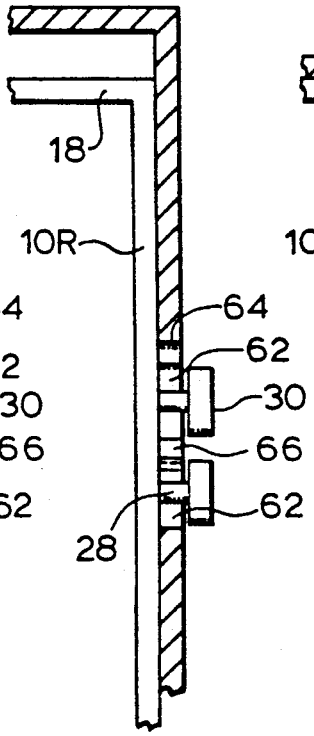
FIG. 7 is a section of an intermediate stage in the attachment of the side rails.
Figure 8:
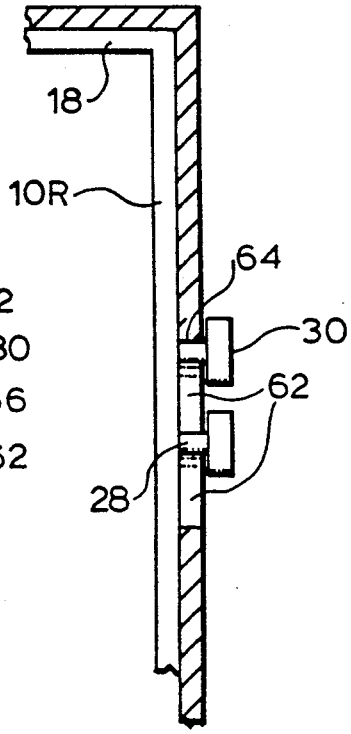
FIG. 8 is a section of the final stage of the attachment of the side rails.
Figure 6:
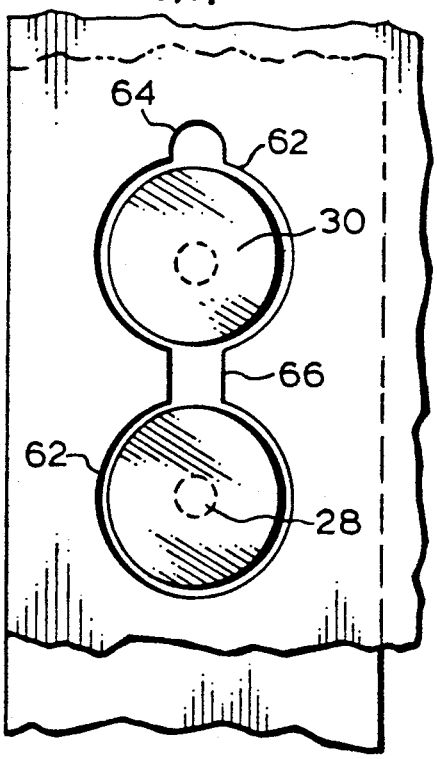
FIG. 6 is a side view corresponding to FIG. 5.
Figure 9:
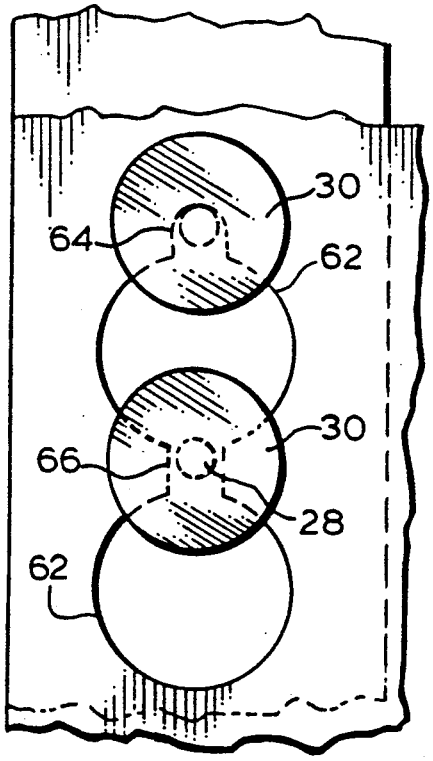
FIG. 9 is a side view corresponding to FIG. 8.

The right hand cross member 18 is integrally connected to a standard 10R, foot 20 and has rivet and stud all as in the left hand member. The right hand cross member 18 extends from over an extended horizontal extent and, looking leftward has a small aperture 48 followed by a slot 50 followed by a small aperture 52 followed by a slot 54. Slots 50 and 54 face in the opposite direction to slot 44 in the left hand member 16. At the inward end the central extent 18C is stepped downwardly at a jog over a sloping extent 56 to an outer extent 18L. The outer extent 18L is provided with a convex upward boss 58. The downwardly sloping extent 56 is slotted at 60 similar to the left hand member slotting at 44. The slot 60 must be on the opposite side of the right hand strip 18 to the slots 40 and 42 in the left hand strip 16. The vertical distance from the lower side of horizontal extent 18C to the upper side of outer extent 18L (the 'open spacing') is just less than the thickness of the left hand cross member. Slot 50, 54 and 60 extend about halfway across the strip. It will be noted that the integral standard 10R and cross member 18 defines (FIGS. 5,7 and 8) mutually perpendicular surfaces at the outside top of the standard 10R and the upper outside of the cross member 18 which surfaces are planes running longitudinally of the file drawer. A similar arrangement is provided for the left hand standards and cross members. The file support rail 14 extends longitudinally and is of L-shaped section providing vertical and horizontal surfaces designed to be clamped against the surfaces referred to above of each integral standard and cross member to interlock the clamped members as hereafter described to form a rigid frame. The support rails are, where necessary, specially shaped to hold the hangers of the vertical files.

The means for clamping the side rails 14 to the integral members comprises a pair of apertures 62 spaced, disposed and dimensioned to receive the two rivet heads 30 when the standards 10 are vertical and the side rail 14 is horizontal. The apertures are joined by a vertical slot 66 designed to receive the shank 28 of the lower rivet and there is a short vertical slot 64 above the upper aperture 62. The slots and apertures are arranged so that with the upper rivet shank 28 at the top of slot 64 the lower rivet shank is about midway along slot 66 and the mutually perpendicular surfaces of the side rail 14 are tight against the respective mutually perpendicular surfaces 10 and 18 of a cross member and a rigid connection between these members is achieved. Thus a rail 14 is assembled to a cross-member by applying the apertures 62 over the rivet heads 30 then sliding the rail downward until the rivet shanks are at their uppermost locations in slots 64 and 62. The rail and cross member are now securely connected but may be disassembled if desired. The clearance between each rivet head 30 and the adjacent surface of rail 14 is preferably made just less than the thickness of rail 14 to supply frictional interference allowing installation of studs 28 in slots 62, 64 but frictionally resisting withdrawal and clamping the mutually perpendicular surfaces of the rail against the mutually perpendicular surfaces of the cross-member.

To assemble the right and left hand cross members the desired width of the files to be supported is selected. For letter size files the outer slots 40 in the left hand strip and 50 in the right hand strip are employed and the slots 54 and 42 are unused (See FIGS. 1, 2 and 3A). For legal size files the slots 54 and 42 are used and 50 and 40 are not (See FIG. 3B).

Assuming letter size files, the strips are fitted with the left hand strip inserted through slot 60 so that slot 40 faces slot 60 at a first partial interlock location, and right hand strip 18 passes from above to below the left looking leftward at slot 60. The strips are manipulated so that slot 44 faces slot 50. The strips are manipulated (FIG. 2) so that the right hand strip edge at slot 60 is received in slot 40 and vice versa while the left hand strip edge opposite slot 44 is received in slot 50 and vice versa so that the left hand strip passes from below to above the right hand strip at slot 44. Thus looking rightward the left hand strip passes from below to above the right at coinciding slots 44, 50 and the right hand strip from below to above at coinciding slots 40, 60. Because each slot is halfway across the strip, the strips lie side by side with their relative position reversed at each interlock position. Because the 'open spacing' of each of slots 44 and 60 is just less than the thickness of the strip received, the resultant interference causes the right hand strip to exert a counter clockwise torque (looking rearward) on the left at slot 44 and a clockwise torque at slot 60. The effect of the interference and the torque is to create a rigid junction between the left and right hand strip members. In the interlocked position detent 58 sits in aperture 36 and detent 53—seats in aperture 48. The cooperation between the detents and apertures acts to maintain the strips side by side and in rigid relationship.

For a legal size file the procedure is the same as outlined above except (See FIG. 3B) the slot 60 is interlocked at slot 42, the slot 44 is manipulated at slot 54, detent 58 rests in aperture 41 and detent 53 rests in aperture 52.

Thus with each of the letter and legal size arrangements, two pairs of partial interlock locations are provided each partial interlock location corresponding to the location of the 'jog' slots 60 and 44.

With the forward and rearward cross-members connected, the side rails may be attached to connect them as already described.

Although it is preferred to make the members described out of mild steel, they may also be made out of other materials including plastic which have the necessary 'springy' or resilient bending quality in the cross member.

I claim:

1. Frame means for supporting hanging files: Comprising:

a rigid frame having standards adapted to rest on a support surface and to extend upwardly therefrom to support forward and rearward transverse frame members joining the two standards at the forward, and the two standards at the rearward ends of the drawer respectively, and right and left longitudinally extending members joining the forward and rearward pairs of standards, respectively, and said longitudinally extending members being spaced and at a height to support vertical files extending between them, characterized by:

each transverse frame member comprises right and left hand stiff, resilient cross members each rigidly joined to a standard and extending inwardly therefrom, said right and left cross members being designed to be located in side by side relationship to provide an overlap extent, partial interlock means between said side by side members at two locations spaced along said overlap extent, said partial interlock means at one of said spaced locations being adapted to cause said right hand cross member to tend to rotate said left hand cross member in one direction relative to an axis approximately perpendicular to the transverse direction, said partial overlap means at the other of said spaced locations being adapted to cause said right hand cross member to tend to rotate said left hand cross member in the other direction relative to an axis parallel to said first mentioned axis.

2. File drawer suspension frame, as claimed in claim 1, wherein said right and left hand cross members are each relatively thin flat strips of stiff, resiliently bendable, material, and are arranged to have respective flat sides side by side, a first pair and second pairs of complementary notches are formed respectively in the right and left hand members and arranged so that at each of said interlock locations a notch from one of said pairs faces a notch of the other so that each facing notch receives the material beside the other facing notch so that the right hand member passes from under to over the left hand member, looking rightward along the cross member at one of said partial interlock locations; and passes from over to under the left hand member looking rightward along the cross members, at the other of said partial interlock locations.

3. Frame means for supporting hanging files: comprising:

a rigid frame having standards adapted to rest on a support surface and to extend upwardly therefrom to support forward and rearward transverse frame members joining the two standards at the forward and the two standards at the rearward ends respectively, and right and left longitudinally extending members joining the forward and rearward pairs of standards, respectively, and said longitudinally extending members being spaced and at a height to support vertical files extending between them, characterized by:

each transverse frame member comprises right and left stiff, resilient cross members each rigidly joined to a standard and extending inwardly therefrom, said right and left cross members being adapted to overlap over an overlap extent, and adapted to interlock at two spaced locations on said overlap extent, and so that at one location the right cross member exerts torque in one direction or the left about an axis approximately perpendicular to the cross member at one of said spaced locations and at the other location the right cross member exerts torque in the other direction on the left about a parallel axis.

4. Frame means for supporting hanging files: comprising:

a rigid frame having standards adapted to rest on a support surface and to extend upwardly therefrom to support forward and rearward transverse frame members joining the two standards at the forward and the two standards at the rearward ends , respectively, and right and left hand pairs of standards, respectively, and said longitudinally extending members being spaced and at a height to support vertical files extending between them, characterized by:

each transverse frame member comprises right and left hand stiff, resilient, strip members extending inwardly from adjacent the upper end of the upright, adapted to overlap in side by side relationship over an overlap extent, a pair of partial interlock locations spaced along said overlap extent, two sets of mutually facing notches, a set consisting of a notch in each of said strip members extending to about halfway across the width of the strip, said strips being arranged so that a set of mutually facing slots coincide at each interlock location, said strips being adapted so that the material defining the inner edge of one mutually facing slot is received in the other member slot and vice versa so that the two strip members reverse their relative side by side positions at each interlock location, said strips being adapted to interlock so that said right hand strip biases the left in one direction at one interlock location and in the opposite direction at the other interlock location.

5. Frame means as claimed in claim 3 wherein each pair of right and left hand cross members are provided with complementary cooperating detent means spaced from each interlock location arranged to releasably resist disconnection of said strips at said interlock means.

6. Frame means as claimed in claim 5 wherein each pair of right and left hand cross members are provided with complementary cooperating detent means spaced from each interlock location arranged to releasably resist disconnection of said strips at said interlock means.

7. Frame means as claimed in claim 1 wherein two pairs of partial interlock means are provided, each set corresponding to an overlap extent of different length, whereby selection of an overlap extent provides a corresponding selection of longitudinally extending member spacing and a corresponding selection of file folder width, for support on the longitudinal members.

8. Frame means as claimed in claim 2 wherein two pairs of partial interlock means are provided, each set corresponding to an overlap extent of different length, whereby selection of an overlap extent provides a corresponding selection of longitudinal member spacing and a corresponding selection of file folder width, for support on the longitudinal members.

9. Frame means as claimed in claim 3 wherein two pairs of partial interlock means are provided, each set corresponding to an overlap extent of different length, whereby selection of an overlap extent provides a corresponding selection of longitudinally extending member spacing and a corresponding selection of file folder width, for support on the longitudinal members.

10. Frame means as claimed in claim 4 wherein two pairs of partial interlock means are provided, each set corresponding to an overlap extent of different length, whereby selection of an overlap extent provides a corresponding selection of longitudinally extending member spacing and a corresponding of file foldee width, for support on the longitudinal members.

11. Frame means as claimed in claim 1 wherein said each of said right and left hand cross members is integral with said standard and interlock means are provided to detachably rigidly connect each integral standard and cross member to longitudinal member.

12. Frame means as claimed in claim 3 wherein said each of said right and left hand cross member is integral with said standard and interlock means are provided to detachably rigidly connect each integral standard and cross member to a longitudinal member.

13. Frame means as claimed in claim 4 wherein said each of said right and left hand cross members is integral with said standard and interlock means are provided to connect each integral standard and cross member to a longitudinal member, said interlock means comprising, a pair of mutually perpendicular surfaces on each of said integral and longitudinal members, each integral member surface being parallel to a longitudinal member surface, said perpendicular surfaces being parallel to the longitudinal direction means for detachably fixing each of said integral member surfaces in side by side relationship with its parallel longitudinal member surface.

14. Frame means as claimed in claim 4 wherein said each of said right and left hand cross members is integral with said standard and interlock means are provided to connect each integral standard and cross member to a longitudinal member, said interlock means comprising, a pair of mutually perpendicular surfaces on each of said integral and longitudinal members, each integral member surface being parallel to a longitudinal member surface, said perpendicular surfaces being parallel to the longitudinal direction means for detachably fixing each of said integral member surfaces in side by side relationship with its parallel longitudinal member surface.

15. Frame means as claimed in claim 3 wherein one of said strips jogs upwardly at its notch corresponding to one interlock location while the other strip is straight at the notch at said location and the other of said strips jogs downwardly at its notch corresponding to the other interlock location while the one strip is straight at the notch facing said other location, and at each interlock location the thickness of the straight strip is just greater than the open spacing between the surfaces of the strip with the jogs.

16. Frame means as claimed in claim 4 wherein one of said strips jogs upwardly at its notch corresponding to one interlock location while the other strip is straight at the notch at said location and the other of said strips jogs downwardly at its notch corresponding to the other interlock location while the one strip is straight at the notch facing said other location, and at each interlock location the thickness of the straight strip is just greater than the open spacing between the surfaces of the strip with the jogs.

17. Frame means as claimed in claim 5 wherein one of said strips jogs upwardly at its notch corresponding to one interlock location while the other strip is straight at the notch at said location and the other of said strips jogs downwardly at its notch corresponding to the other interlock location while the one strip is straight at the notch facing said other location, and at each interlock location the thickness of the straight strip is just greater than the open spacing between the surfaces of the strip with the jogs.

* * * * *